US005987787A

United States Patent [19]

Mack

[11] Patent Number: 5,987,787

[45] Date of Patent: Nov. 23, 1999

[54] GROUND ENGAGING TOOL COMPONENTS

[75] Inventor: Noel Raymond Mack, Sandton, South Africa

[73] Assignee: Wright Equipment Company (Proprietary) Limited, South Africa

[21] Appl. No.: 09/021,747

[22] Filed: Feb. 11, 1998

[51] Int. Cl.[6] ..... E02F 9/28

[52] U.S. Cl. ..... 37/456; 37/195; 37/903; 172/713; 172/753; 172/772.5

[58] Field of Search ..... 172/713, 751, 172/749, 753, 772, 772.5, 701.2, 701.3, 719, 1; 37/456, 455, 452, 453, 450, 195, 446, 903

[56] References Cited

U.S. PATENT DOCUMENTS

| | | | |
|---|---|---|---|
| 1,837,341 | 12/1931 | Shaffer | 37/456 |
| 1,845,677 | 2/1932 | Mekeel | 37/456 X |
| 5,233,770 | 8/1993 | Robinson | 37/456 |
| 5,782,019 | 7/1998 | Launder et al. | 37/456 X |
| 5,806,215 | 9/1998 | Matthews | 37/456 X |

FOREIGN PATENT DOCUMENTS

| | | | |
|---|---|---|---|
| 950501 | 7/1974 | Canada | 37/456 |
| 4306329 | 10/1992 | Japan | 37/456 |

*Primary Examiner*—Christopher J. Novosad
*Attorney, Agent, or Firm*—Jones & Askew

[57] ABSTRACT

An assembly of ground engaging tool components which are attachable to the lip of a bucket of an earth moving machine. The assembly includes a nosepiece attachable to the lip of the bucket, an adapter attachable to the nosepiece, and a tip attachable to the adaptor. The components are attachable to one another by spigot and socket arrangements, the relevant spigot in each case defining two opposed tapered faces and a pair of side faces spacing the tapered faces from one another, at least one of the side faces of the spigot defining a groove with opposed side walls which are tapered in an opposite sense to the taper on the opposed tapered faces. Similarly, the relevant socket in each case has opposed internal tapered faces which correspond to the tapered faces on the spigot, and a pair of internal side faces spacing the internal tapered faces from one another, at least one of the internal side faces including a wedge having opposed side walls which are tapered in an opposite sense to the taper on the opposed internal tapered faces of the socket and which correspond to the taper on the opposed side walls of the groove. Each spigot is arranged to fit within a corresponding socket so that the wedge lies within the groove, is movable along the length of the groove, and can be wedged therein when the two opposed tapered faces on the spigot mate with the two opposed internal tapered faces in the socket.

13 Claims, 3 Drawing Sheets

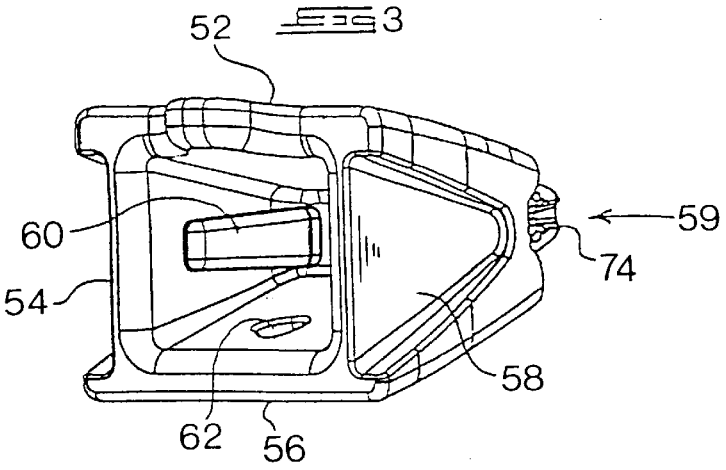
52
3
60
59
74
54
58
62
56
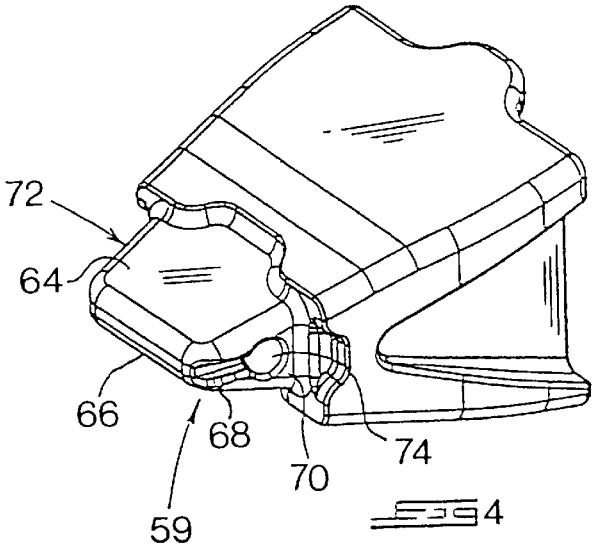
72
64
66
68
74
70
59
4
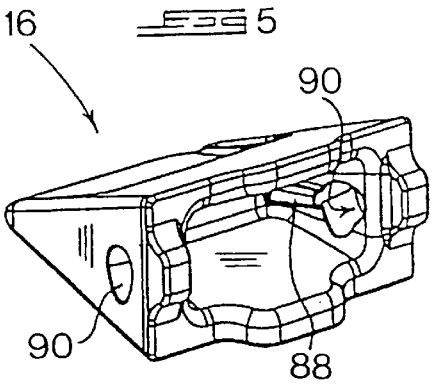
16
5
90
90
88
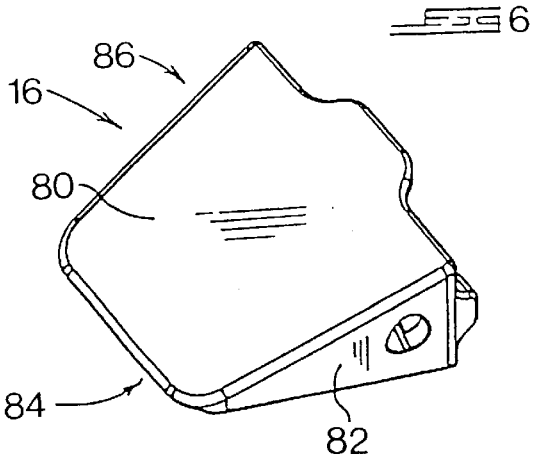
6
86
16
80
84
82

Fig 7
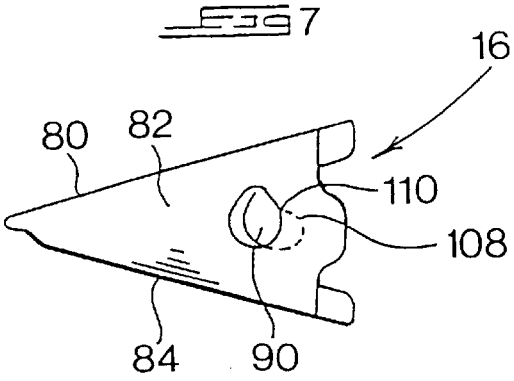
Fig 8
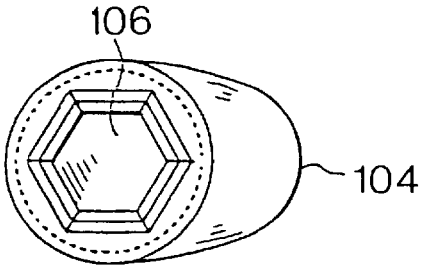
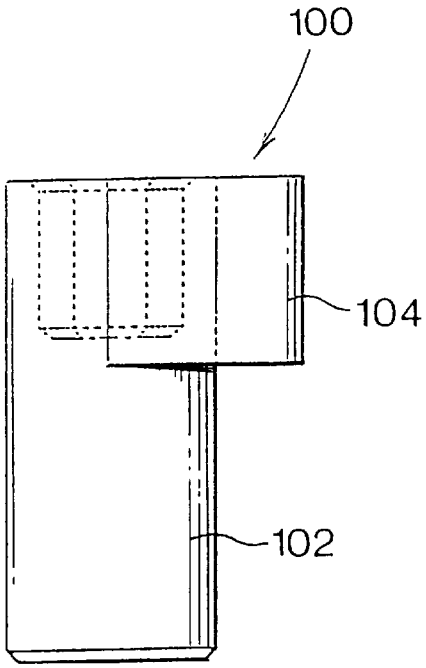
Fig 9
Fig 10
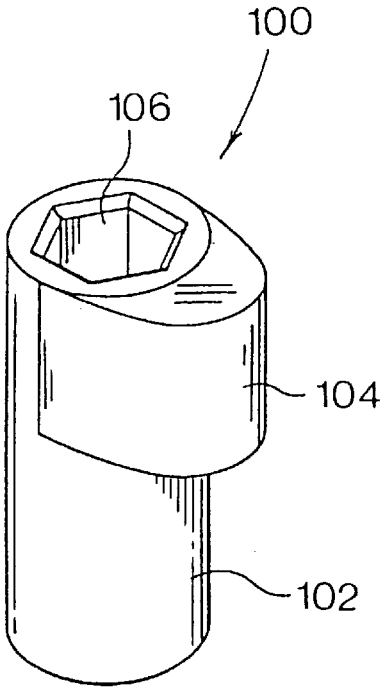

GROUND ENGAGING TOOL COMPONENTS

BACKGROUND OF THE INVENTION

This invention relates to ground engaging tools, and in particular to an assembly of ground engaging tool components.

A large proportion of the machinery used in earth moving operations utilise buckets. The teeth attached to the lips of such buckets are generally subject to considerable wear and it is therefore necessary to replace these teeth, or at least portions of them, periodically.

For this reason a number of methods have been developed for releasably attaching ground engaging teeth to the lips of buckets of various earth moving machinery. In some of these methods a series of nosepieces are connected to the lip of a bucket, side by side, and an adaptor is used to releasably connect a tip to each nosepiece. A shroud may also be attached to adjacent nosepieces to provide a wear surface between successive teeth, if desired.

SUMMARY OF THE INVENTION

According to one aspect of the invention there is provided a method of connecting together two ground engaging tool components, the method comprising the steps of:

providing on one of the components a spigot having two opposed tapered faces which are spaced apart from one another by two side faces;

forming a groove on at least one of the side faces, the opposed side walls of the groove being tapered in an opposite sense to the taper on the opposed tapered faces;

forming in the second component a socket having opposed internal tapered faces corresponding to the opposed tapered faces on the spigot, the internal tapered faces of the socket being spaced apart by two internal side faces corresponding to the side faces of the spigot;

providing a wedge on at least one of the internal side faces of the socket, the opposed side walls of the wedge being tapered in an opposite sense to the taper on the opposed internal tapered faces of the socket so as to correspond to the taper on the opposed side walls of the groove;

fitting the spigot of the first component into the socket of the second component so that the wedge on the second component lies within the groove of the first component and is movable along the length of the groove so that it can be wedged therein when the two opposed tapered faces on the spigot mate with the two opposed internal tapered faces in the socket; and providing holding means on the components for holding them together until a working load is applied to the components and the wedge is driven along the groove so as to become wedged therein, thereby firmly securing the two components together.

Preferably, the step of providing holding means on the components comprises passing a locking pin through aligned apertures on the two components to secure the components together until a working load is applied to the components.

According to a second aspect of the invention there is provided an assembly of ground engaging tool components comprising:

a first component having a spigot which defines two opposed tapered faces and a pair of side faces spacing the tapered faces from one another, at least one of the side faces of the spigot defining a groove with opposed side walls which are tapered in an opposite sense to the taper on the opposed tapered faces;

a second component defining a socket having opposed internal tapered faces which correspond to the tapered faces on the spigot, and a pair of internal side faces spacing the internal tapered faces from one another, at least one of the internal side faces including a wedge having opposed side walls which are tapered in an opposite sense to the taper on the opposed internal tapered faces of the socket and which correspond to the taper on the opposed side walls of the groove, the spigot on the first component being arranged to fit within the socket in the second component so that the wedge on the second component lies within the groove of the first component and is movable along the length of the groove so that it can be wedged therein when the two opposed tapered faces on the spigot mate with the two opposed internal tapered faces in the socket; and holding means on the components for holding them together until a working load is applied to the components and the wedge is driven along the groove so as to become wedged therein, thereby firmly securing the two components together.

The assembly of ground engaging tool components may be a tooth assembly connectable to the lip of a bucket of an earth moving machine.

Conveniently, the side faces of the spigot and the internal side faces of the socket are also tapered.

Preferably, the holding means is a locking pin arranged to pass through alignable apertures in the two components to secure the components together until the working load is applied to the components.

The pin may include a shank and a non-symmetrically shaped resilient head which extends laterally from the shank. In this case the aperture in the second component is sized and shaped to allow the enlarged head of the pin to pass therethrough, while the aperture in the first component is sized and shaped to allow only the shank, and not the head, of the pin to pass therethrough. In this way, once the locking pin has been passed through the apertures so that the head bears against the spigot, the locking pin can be rotated with respect to the components so that the non-symmetrically shaped head is rotated into a recess in the side wall of the aperture in the second component to thereby lock the two components together.

The recess in the side wall of the aperture in the second component may include a node at one end so that a predetermined torque is required to turn the head into the recess. In this case, the recess may be sized so that the resilient head is captured and held in compression within the recess.

Conveniently, the components are formed from steel. The components may also include tungsten steel inclusions.

Preferably, the shank of the locking pin is formed from steel and the resilient head is formed from a high density polyurethane compound.

The invention further provides for a locking pin for locking together two ground engaging tool components, the locking pin comprising:

a generally elongate shank;

a non-symmetrically shaped head which extends laterally from the shank, the head being sized and shaped to pass through an aperture in one of the components but not through an aperture in the other of the components; and a formation on the pin for engaging a rotatable member so that the head can be rotated into a recess on a portion of the side wall of the aperture through which the head can pass.

BRIEF DESCRIPTION OF THE DRAWINGS

The invention will now be described in more detail, by way of example only, with reference to the accompanying drawings in which:

FIG. 3 shows a rear perspective view of an adaptor according to the invention;

FIG. 4 shows a front perspective view of the adaptor of FIG. 3;

FIG. 5 shows a rear perspective view of a tip according to the invention;

FIG. 6 shows a front perspective view of the tip of FIG. 5;

FIG. 7 shows a side view of the tip of FIG. 5;

FIG. 8 shows a top plan view of a locking pin according to the invention;

FIG. 9 shows a front view of the locking pin of FIG. 8; and

FIG. 10 shows a perspective view of the locking pin of FIG. 8.

DESCRIPTION OF A PREFERRED EMBODIMENT

Figure 1:
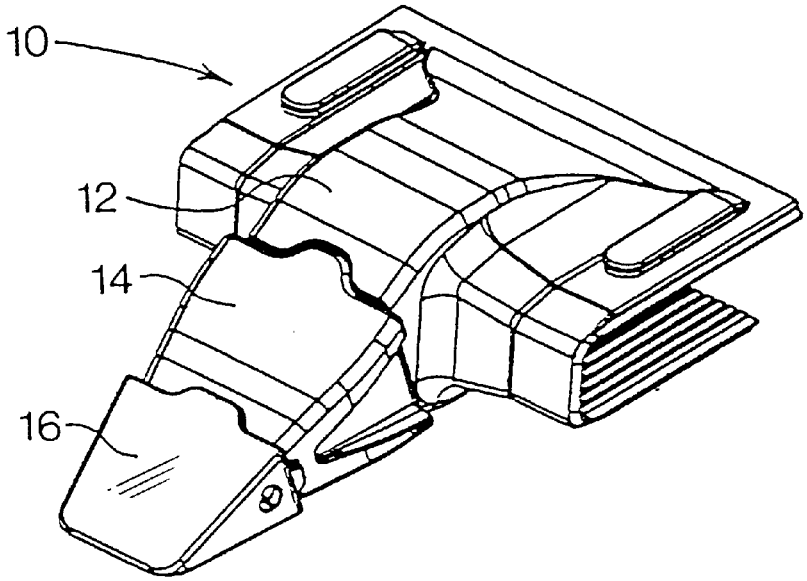
FIG. 1 shows a front perspective view of a tooth assembly according to the invention.

FIG. 1 shows a perspective view of ground engaging tool components in the form of a tooth assembly 10 which is connectable to the lip of a bucket (not illustrated) of an earth moving machine. Typically, a series of such assemblies are arranged side by side on the lip of the bucket to provide a plurality of spaced apart teeth on the bucket.

The tooth assembly 10 comprises a nosepiece 12, an adaptor 14 releasably connected to the nosepiece, and a tip 16 releasably connected to the adaptor.

Figure 2:
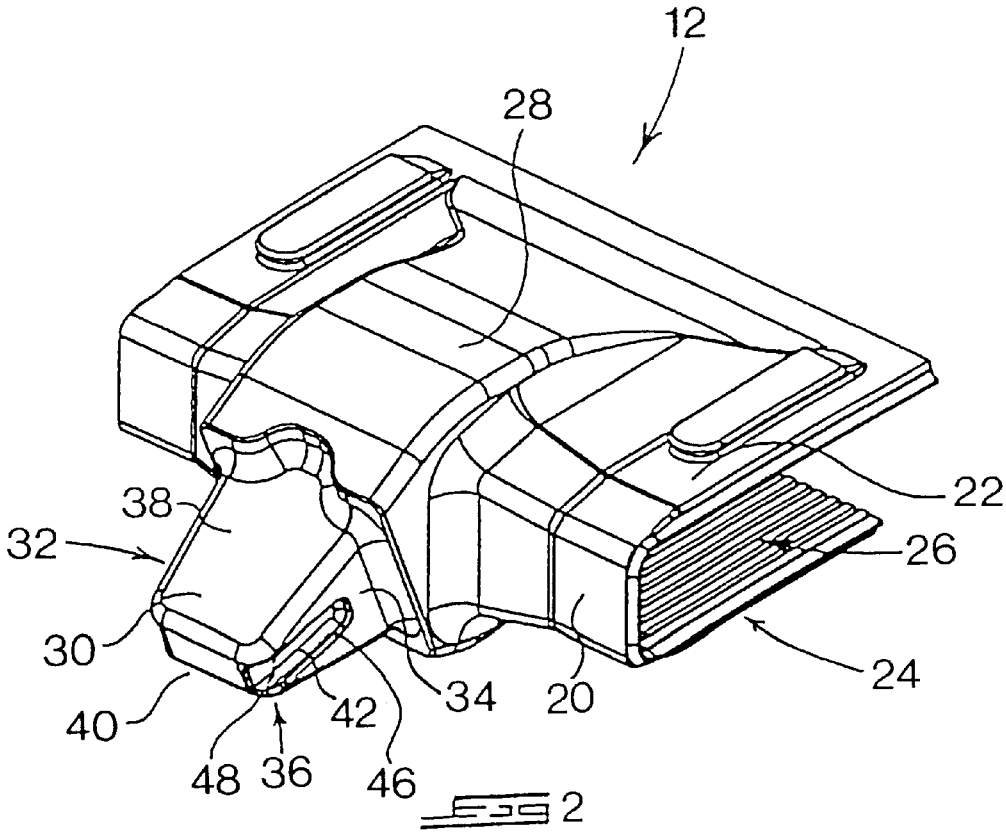
FIG. 2 shows a front perspective view of a nosepiece according to the invention.

Referring to FIG. 2 of the drawings, the nosepiece 12 has a front face 20 and upper and lower faces 22 and 24 extending back from the front face to form a shallow U-shaped formation which defines a channel 26. The channel 26 is sized to fit over the lip of a conventional bucket for earth moving machinery. A central rib 28 projects outwardly from the upper and lower faces 22 and 24, and forwardly from the front face 20, as shown. The rib 28 includes a spigot 30 which also projects forwardly.

The spigot 30 has two side faces 32 and 34, a bottom face 36 and a top face 38 which all taper inwardly towards the free end 40 of the spigot. A tapered groove 42 extends rearwardly from the free end 40 along each of the side faces 32 and 34. The grooves 42 have side walls 46 and 48 which converge towards one another as they move away from the free end 40 of the spigot.

The bottom face 36 of the spigot 30 defines a generally circular aperture (not shown) for receiving a locking pin (also not shown).

FIGS. 3 and 4 illustrate the adaptor 14 which is connectable to the nosepiece 12. The adaptor 14 is in the form of a hollow, steel, generally wedge-shaped body which has four sides 52, 54, 56 and 58. The four sides converge towards one end 59 of the adaptor. On the inside of each of the sides 54 and 58 there is a wedge 60 which is shaped to engage with the groove 42 on the nosepiece 12. Accordingly, the side walls of the wedges 60 converge complementally to the side walls of the grooves 42.

The side 56 of the adaptor 14 defines an aperture 62 for receiving a non-symmetrical head of a locking pin (not shown). The shape of the aperture will be described in more detail below.

An adaptor spigot 64 projects from the end 59 of the adaptor 14. The adaptor spigot is similar in shape to the nosepiece spigot 30 and also has sides which taper towards the free end 66 thereof. Also similarly to the nosepiece spigot, the adaptor spigot 64 has a pair of tapered grooves 68 which are formed on the sides 70 and 72 of the spigot. Unlike the nosepiece spigot, however, the adaptor spigot defines a generally circular aperture 74 on each side 70 and 72, at the rearmost end of each groove 68.

The tip 16 is illustrated in FIGS. 5 to 7 of the drawings and is also in the form of a hollow, steel, substantially wedge-shaped body. In the case of the tip, the steel may include tungsten steel inclusions to improve the wear characteristics of the tip. The tip has four wear faces 80, 82, 84 and 86 which are designed to contact the earth and rubble being loaded into the bucket. On the inside of the wear faces 82 and 86 a tapered wedge 88 extends in a similar fashion to the wedge 60 on the adaptor 14. Furthermore, the wear faces 82 and 86 also define non-symmetrical apertures 90 for receiving the non-symmetrical head of a locking pin (not shown).

In FIGS. 8 to 10 there is shown a locking pin 100 which has a steel, circular cylindrical shank 102 and a non-symmetrical head 104 in the form of a cam formed from a high density polyurethane compound having a Shore hardness of between 80 and 90. The head 104 is cast integrally with the shank 102. The locking pin 100 includes a recessed formation 106 which is shaped to receive a key or the like so that the locking pin can be rotated.

Referring again to FIG. 7 of the drawings, the apertures 90 are generally oval or egg-shaped, as shown, to receive the heads 104 of locking pins 100. Each aperture 90 includes a recessed portion 108 on a portion of the side wall of the aperture remote from each wear face 82 and 86 into which the head 104 can be turned. Accordingly, once the locking pin has been slid into the wear face 82 and the head 104 has been turned into the recess 108 the locking pin cannot be slid out of the wear face unless it is first rotated out of the recess.

The recess 108 also includes a node 110 at the entrance thereto so that a predetermined torque is required to rotate the head 104 into this recess. Once the head has been rotated into the recess, it is captured there by the node 110. The size of the recess is slightly smaller than that of the head so that the resilient material of the head is compressed when it is captured in the recess.

The shape of the aperture 62 is similar to that of the aperture 90, while the shape of the apertures 74 in the spigot 64 and the aperture in the bottom face 36 of the spigot 30 are generally circular.

In use, the nosepiece 12 is connected to the lip of a bucket (not illustrated) by a suitable means, such as by welding. Thereafter, the adaptor 14 is slid onto the spigot 30 of the nosepiece 12 so that the wedges 60 lie within the grooves 42 and the aperture 62 is aligned with the aperture on the bottom face 36 of the spigot 30. The wedges and grooves are designed so that the side walls of the wedges bear against the side walls of the grooves when the tapered faces 32, 34, 36 and 38 mate with the tapered sides 52, 54, 56 and 58. In this position the aperture 62 in the adaptor is aligned with the corresponding aperture in the nosepiece.

At this stage a locking pin (as illustrated in FIGS. 8 to 10 of the drawings) is fitted into the aligned apertures so that the shank 102 passes through both apertures but the head 104 passes through the aperture 62 only and bears against the bottom face 36. Thereafter the head of the locking pin 100 is rotated, with the aid of a key or the like, into the recess of the aperture 62 so as to be captured in the recess for locking the adaptor 14 to the nosepiece 12. The adaptor 14 is then substantially fixed with respect to the nosepiece 12 by virtue of the relatively close tolerance fit between the adaptor and the nosepiece. Furthermore, the adaptor 14 is wedged onto the nosepiece as a result of the compressive force on the resilient head of the locking pin 100 in the recess. However, although the interaction between the tapered wedges 60 and the tapered grooves 42 serves to resist creep between the mating tapered faces of the adaptor 14 and the nosepiece 12, the adaptor is capable of being forced slightly further onto the nosepiece when a working load is applied to the components so as to be wedged more securely onto the nosepiece.

Once the adaptor 14 has been locked to the nosepiece, the tip 16 is slid onto the adaptor spigot 64 in a similar fashion to that described above with respect to the adaptor and the nosepiece so that the wedges 88 on the tip lie within the grooves 68 on the adaptor. Once again, the apertures 90 and 74 are aligned with one another when the side walls of the wedges 88 bear against the side walls of the grooves 68.

A locking pin similar to that illustrated in FIGS. 8 to 10 is then inserted into the apertures 90 and 74 as described above and the head of the locking pin is rotated into the recess 108 so as to lock the tip 16 onto the adaptor 14. The tip and adaptor are also capable of slight additional creep with respect to one another under a working load until the two are wedged securely to one another.

The locking pin serves mainly to initially secure the components together until, under a working load, the components are securely seated upon one another. In this way movement of one of the components relative to the others is substantially eliminated and shock loading is considerably reduced.

When a series of adaptors and tips have been connected to a number of nosepieces on the lip of a bucket in the manner described above, a series of spaced apart teeth are securely wedged to the lip of the bucket.

Since the side walls of the grooves and wedges taper in an opposite sense to that of the opposed tapered faces of the spigots and sockets, the wedging action for securing the components together is improved.

Although the invention has been described with particular reference to tooth assemblies for attachment to the lips of the buckets of earth moving machinery, it should be appreciated that the invention is not limited to such tooth assemblies and may also be applied in the connection of various other ground engaging tool components.

I claim:

1. A method of connecting together two ground engaging tool components, the method comprising the steps of:

providing on a first of the components a spigot having two opposed tapered faces which are spaced apart from one another by two side faces;

forming a groove on at least one of the side faces, opposed side walls of the groove being tapered in an opposite sense to the taper on the opposed tapered faces;

forming in a second of the components a socket having opposed internal tapered faces corresponding to the opposed tapered faces on the spigot, the internal tapered faces of the socket being spaced apart by two internal side faces corresponding to the side faces of the spigot;

providing a wedge on at least one of the internal side faces of the socket, opposed side walls of the wedge being tapered in an opposite sense to the taper on the opposed internal tapered faces of the socket so as to correspond to the taper on the opposed side walls of the groove;

fitting the spigot of the first component into the socket of the second component so that the wedge on the second component lies within the groove of the first component and is movable along a length of the groove so that the wedge can be wedged therein when the two opposed tapered faces on the spigot mate with the two opposed internal tapered faces in the socket; and providing holding means for holding the components together until a working load is applied to the components and the wedge is driven along the groove so as to become wedged therein, thereby firmly securing the two components together.

2. The method according to claim 1, wherein the step of providing holding means includes passing a locking pin through aligned apertures in the two components to secure the components together.

3. An assembly of ground engaging tool components comprising:

a first component having a spigot which defines two opposed tapered faces and a pair of side faces spacing the tapered faces from one another, at least one of the side faces of the spigot defining a groove with opposed side walls which are tapered in an opposite sense to the taper on the opposed tapered faces;

a second component defining a socket having opposed internal tapered faces which correspond to the tapered faces on the spigot, and a pair of internal side faces spacing the internal tapered faces from one another, at least one of the internal side faces including a wedge having opposed side walls which are tapered in an opposite sense to the taper on the opposed internal tapered faces of the socket and which correspond to the taper on the opposed side walls of the groove, the spigot on the first component being arranged to fit within the socket in the second component so that the wedge on the second component lies within the groove of the first component and is movable along the length of the groove so that it can be wedged therein when the two opposed tapered faces on the spigot mate with the two opposed internal tapered faces in the socket; and holding means for holding the components together until a working load is applied to them and the wedge is driven along the groove so as to become wedged therein, thereby firmly securing the two components together.

4. The assembly of ground engaging tool components according to claim 3, wherein the assembly is a tooth assembly connectable to a lip of a bucket of an earth moving machine.

5. The assembly of ground engaging tool components according to claim 3, wherein the side faces of the spigot and the internal side faces of the socket are also tapered.

6. The assembly of ground engaging tool components according to claim 3, wherein the holding means is a locking pin arranged to pass through alignable apertures in the two components to secure the components together.

7. The assembly of ground engaging tool components according to claim 6, wherein the pin includes a shank and a non-symmetrically shaped, resilient head which extends laterally from the shank.

8. The assembly of ground engaging tool components according to claim 7, wherein the aperture in the second component is sized and shaped to allow the head of the pin to pass therethrough, while the aperture in the first component is sized and shaped to allow only the shank, and not the head, of the pin to pass therethrough.

9. The assembly of ground engaging tool components according to claim 8, wherein a portion of a side wall of the aperture in the second component includes a recess for receiving the head of the pin.

10. The assembly of ground engaging tool components according to claim 9, wherein the recess includes a node at one end thereof so that a predetermined torque is required to turn the head into the recess.

11. The assembly of ground engaging tool components according to claim 10, wherein the recess is sized so that the resilient head is captured and held in compression within the recess.

12. The assembly of ground engaging tool components according to claim 7, wherein the shank of the locking pin is formed from steel and the resilient head is formed from a high density polyurethane compound.

13. The assembly of ground engaging tool components according to claim 3, wherein the components are formed from steel and at least one of the components includes tungsten steel inclusions.

* * * * *